United States Patent [19]

Petrovic

[11] 4,173,325

[45] Nov. 6, 1979

[54] SPRAYER

[75] Inventor: John E. Petrovic, Ft. Collins, Colo.

[73] Assignee: Teledyne Industries, Inc., Ft. Collins, Colo.

[21] Appl. No.: 3,919

[22] Filed: Jan. 16, 1979

Related U.S. Application Data

[62] Division of Ser. No. 861,166, Dec. 17, 1997.

[51] Int. Cl.[2] ..... B05B 15/06

[52] U.S. Cl. ..... 248/81; 239/280

[58] Field of Search ..... 239/273, 280, 280.5, 239/281, 588; 248/75, 80–82

[56] References Cited

U.S. PATENT DOCUMENTS

| | | | |
|---|---|---|---|
| 1,631,874 | 6/1927 | Lasher et al. | 248/81 |
| 2,200,503 | 5/1940 | Judell et al. | 248/75 X |

*Primary Examiner*—Robert W. Saifer

*Attorney, Agent, or Firm*—Hugh H. Drake

[57] ABSTRACT

A sprayer has a hollow housing with an inlet port and an outlet opening. A cap assembly closes the outlet opening and includes a plurality of sets of discharge orifices with each set exhibiting an individually different characteristic of orifice flow of fluid from the housing interior. The orifice sets are selectively opened to the passage of flow out of the housing and that flow is valved. Different sets of the orifices provide for a fine-spray cone, larger streams and a swirling jet. A porting seal cooperates with a selector plate to enable fluid communication to different sets of orifices and an overall valving assembly also is included. Still further is a stand for the sprayer which supports it, when desired, above a holder or in a manner which enables convenient storage.

2 Claims, 27 Drawing Figures

SPRAYER

RELATED APPLICATION

The present application is a division of co-pending parent application Ser. No. 861,166, filed Dec. 17, 1977.

The present invention pertains to a sprayer. More particularly, it relates to a multiple-function spray device as well as to associated apparatus.

Many conventional kitchen sinks include a device known as a vegetable spray. It seats in an opening to one side of the main faucet assembly and is connected to a diverter valve in the main incoming supply line so as to be supplied with water at least whenever the main faucet assembly is supplied with water. The vegetable spray normally includes a head mounted upon a flexible hose which may be withdrawn from a seat so as to enable the spray to be used within the sink for a variety of purposes. Usually, the spray head includes its own valve for controlling the emission of the spray. The discharge is typically in a cone of individual jets so as to perform like a showerhead. Of course, it has proved to be most useful in cleaning food products under preparation as well as in performing other chores such as cleaning cookingware.

Somewhat recently, it has been suggested to modify the formerly conventional vegetable spray by including a water filter employed in one of its modes of operation. In that case, a normal cone diffusion of spray is provided in a manner of flow which is exclusive of the filter, while a different mode of water discharge is provided for water that flows through the filter. One example of that is disclosed in application Ser. No. 784,420, filed Apr. 4, 1977, now Letters Pat. No. 4,107,046, issued Aug. 15, 1978. As particularly embodied, the spray cone is of fixed configuration.

On the other hand, considerable interest has in recent years been shown with respect to the implementation of a variety of spray modes in showerheads designed for bathing. Much attention has been directed to the provision of pulsating, swirling or other modes of spray delivery, in addition to continuous spray, for the purpose of achieving enhanced results. Exemplary of such approaches are those described in U.S. Pat. Nos. 3,762,648, 3,801,019 and 3,958,756. In terms of structure, such devices may become rather involved in order to achieve best performance.

In view of the foregoing, it is a general object of the present invention to provide a multiple-mode sprayer which is effective in achieving that end while yet being comparatively simple in structure.

Another object of the present invention is to provide a new and improved sprayer which provides a range of control as between vigorous and gentle action of the outletted spray.

One specific object of the present invention is to provide a new and improved vegetable spray.

Still another object of the present invention is to provide a new and improved sprayer that affords versatile characteristics of operation and yet which is so arranged as to be economical of production, assembly and adaptation to usage.

Basically, the invention pertains to a sprayer which includes a hollow housing that has an inlet port and an outlet opening. A cap closes the outlet opening and includes a plurality of sets of discharge orifices with each set exhibiting an individually different characteristic of orifice flow of fluid from the interior of the housing. Also included are means for selectively opening respective orifice sets for the passage of flow out the housing and valving the flow of fluid through the housing. One improvement takes the form of a first set of orifices in the cap circumferentially spaced apart and individually sized to define a fine-spray cone. A second set of orifices in the cap are circumferentially spaced apart individually and sized to define respective streams substantially larger than the spray elements from the orifices of the first set. Still another orifice in the cap, which is independent of the first and second sets, is furnished to define a different flow characteristic. The opening means selects as between the first set, the second set and that other orifice.

Another feature relates to the inclusion of one orifice sized to define a stream and selectable for flow by the opening means. Included in the cap is an interior cup which surrounds that orifice. A plurality of nozzles also are defined in the cap and are directed into the cup at an angle so as to induce a swirling of the stream and produce a mist.

Still another feature has to do with a porting seal which is disposed adjacent to the interior wall of the cap and includes a plurality of apertures individually distributed in an array such that different ones of the apertures communicate with respective different ones of the sets of orifices. A selector plate is disposed adjacent to the interior side of the seal and includes at least one hole selectively movable to communicate with respective apertures.

As a still further feature, there is an element disposed within the housing that is rotatable for effecting the selective determination of the opening of respective orifice sets. A stem coupled at one end to the element moves the latter in rotation. Disposed on the stem is a valve member. A valve seat formed in the housing cooperates with the valve member, upon reciprocation of the stem, for opening and closing the passage of fluid flow from the inlet toward the outlet opening. Exposed outside the housing and coupled to the stem is means for enabling either rotation or reciprocation of the stem.

Finally, there also is an associated sprayer stand for use to support the sprayer above a holder. The stand includes a releasable clamp securable upon the device and a support rod of a length to extend between the holder and the clamp. There is an opening through the holder in which the rod is slidable to accommodate storage of the device. An upstanding recess in the holder seats a lower end of the rod to dispose the upper end of the same above the holder, with the clamp being secured upon the upper end of the rod.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figures 8, 9:
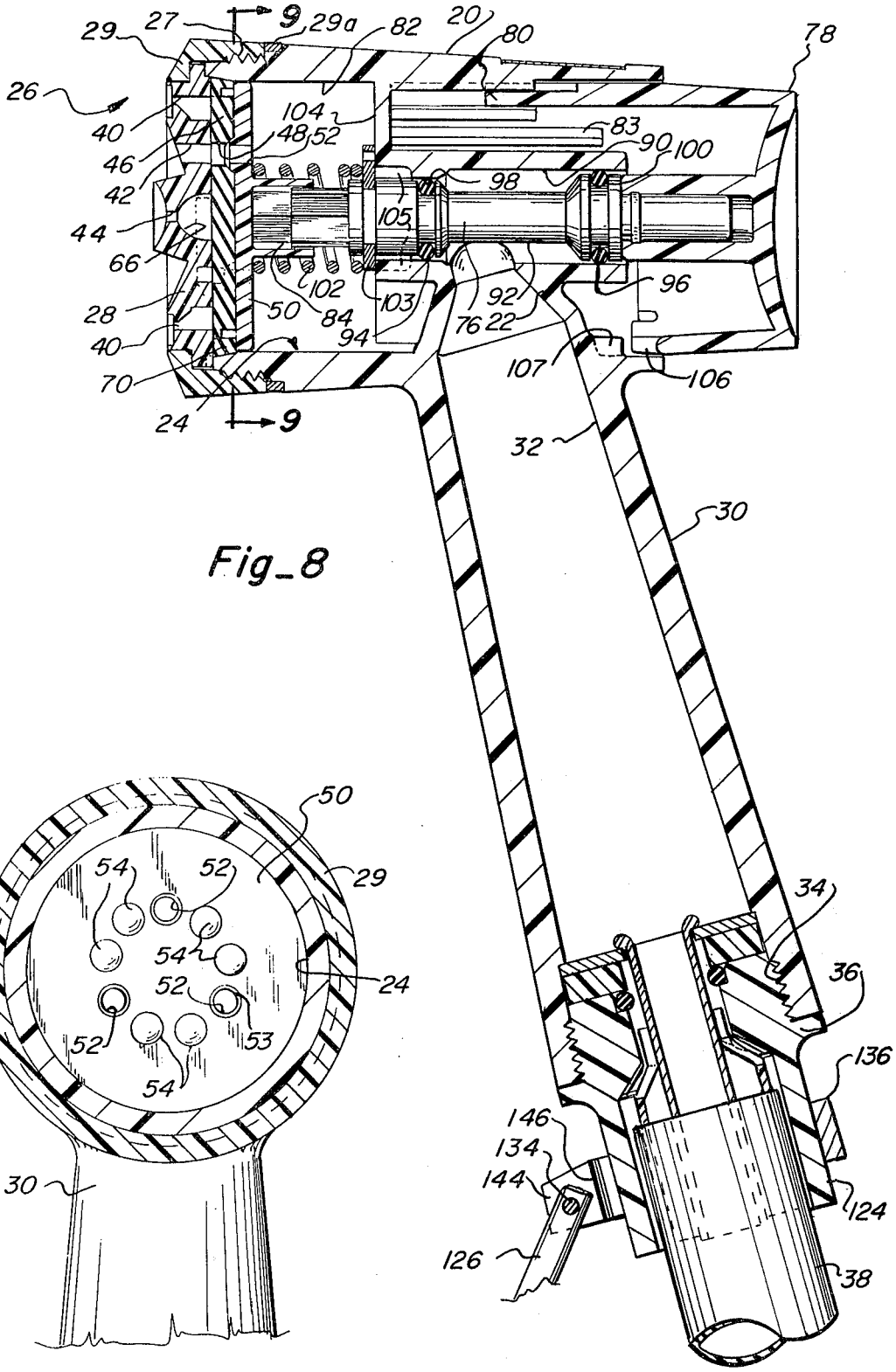
FIG. 8 is an enlarged cross-sectional view taken along the line 8—8 in FIG. 6.
FIG. 9 is a cross-sectional view taken along the line 9—9 in FIG. 8.
Figure 10:
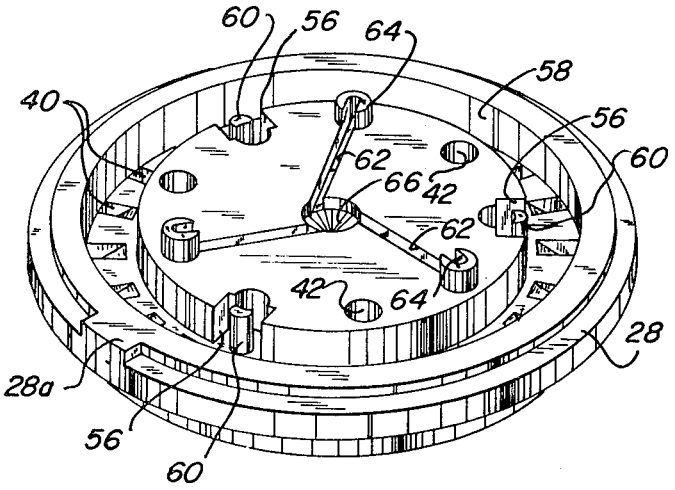
FIG. 10 is an enlarged perspective view of a component included in the sprayer as shown in FIG. 8.
Figure 12:
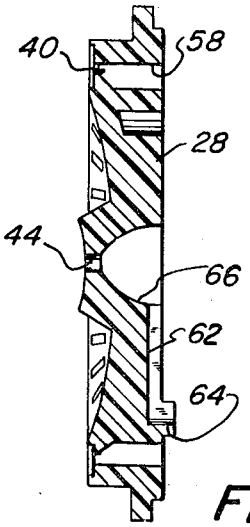
FIG. 12 is a cross-sectional view taken along the line 12—12 in FIG. 11.
Figure 11:
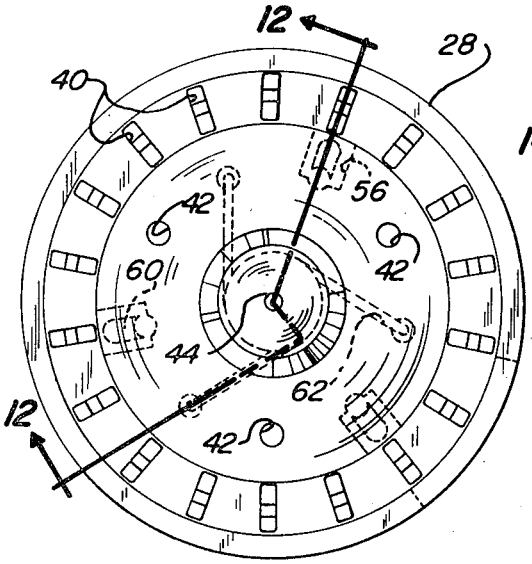
FIG. 11 is a bottom plan view of the component shown in FIG. 10.
Figure 13:
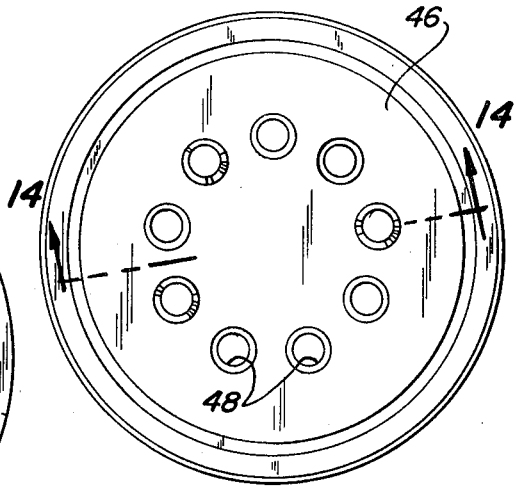
FIG. 13 is a plan view of another component included within the sprayer as shown in FIG. 8.
Figure 14:
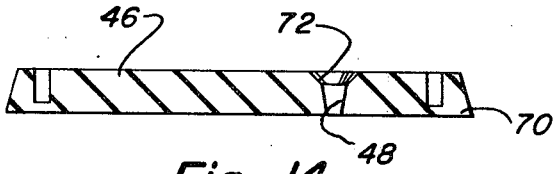
FIG. 14 is a cross-sectional view taken along the line 14—14 in FIG. 13.
Figure 15:
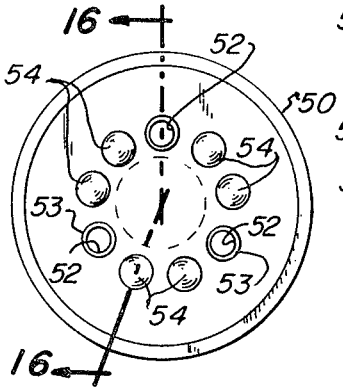
FIG. 15 is a plan view of still another component included in the sprayer as shown in FIG. 8.
Figure 16:
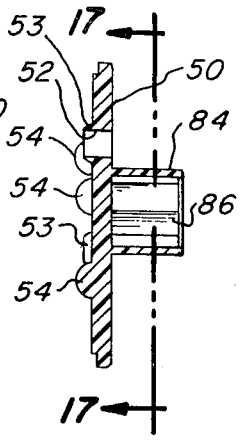
FIG. 16 is a cross-sectional view taken along the line 16—16 in FIG. 15.
Figure 17:
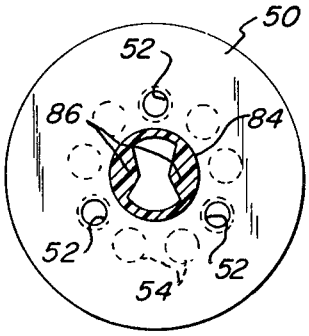
FIG. 17 is a cross-sectional view taken along the line 17—17 in FIG. 16.
Figure 18:
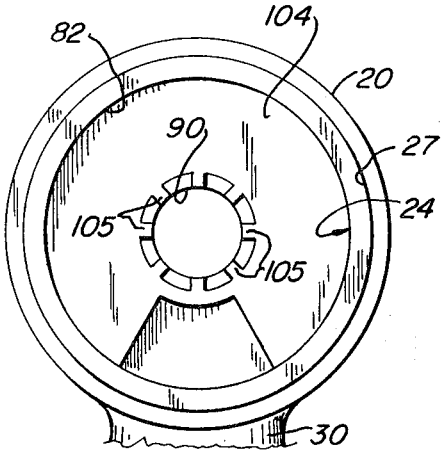
FIG. 18 is a fragmentary view taken along the line 18—18 in FIG. 7.
Figure 21:
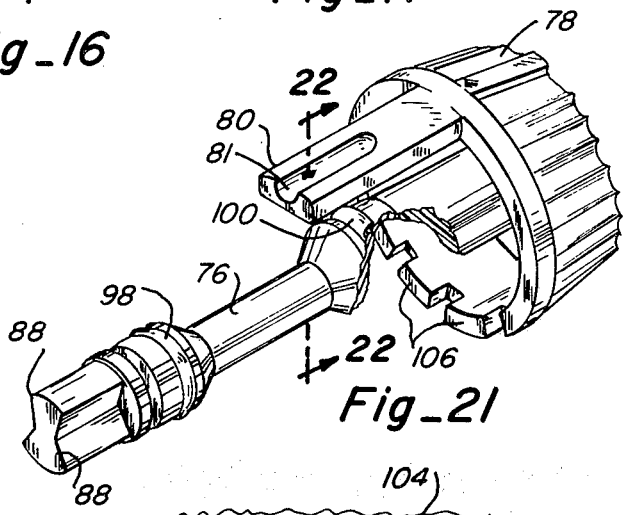
Figure 20:
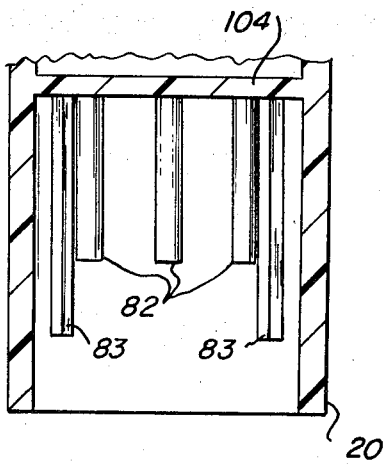
FIG. 20 is a fragmentary cross-sectional view taken along the line 20—20 in FIG. 19.
Figure 19:
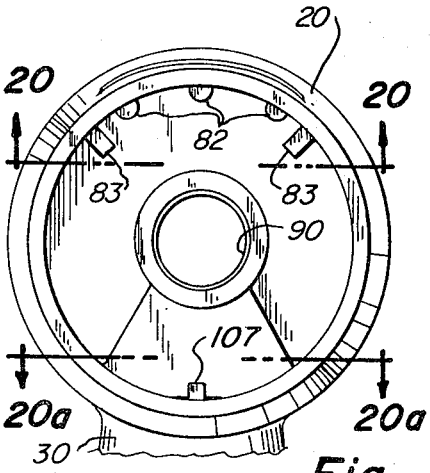
FIG. 19 is a fragmentary view taken along line 19—19 in FIG. 7.
Figure 23:
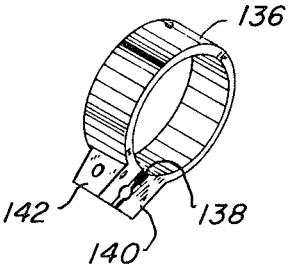
Figure 24:
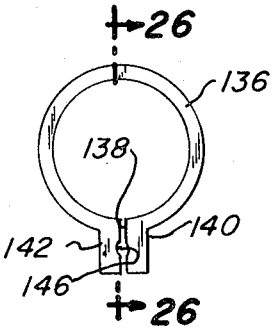
Figure 25:
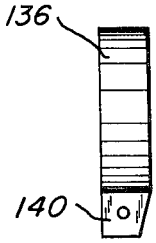
Figure 26:
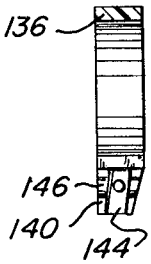
Figure 22:
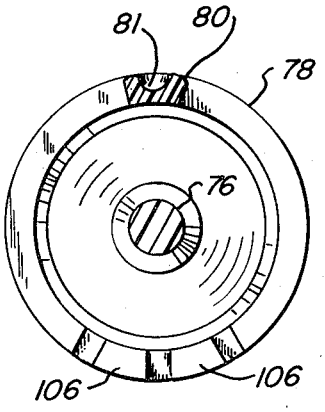
Figure 20A:
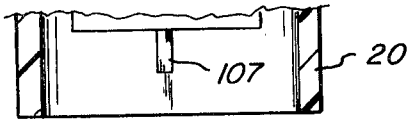

FIG. 20*a* is a fragmentary cross-sectional view taken along the line 20*a*—20*a* in FIG. 19;

FIG. 21 is a perspective view of a further component of the sprayer as shown in FIG. 8;

FIG. 22 is a cross-sectional view taken along the line 22—22 in FIG. 21;

FIG. 23 is a perspective view of a mounting component shown in FIGS. 1–5 and 8;

FIG. 24 is a plan view of the component shown in FIG. 23;

FIG. 25 is a side-elevational view of the component shown in FIGS. 23 and 24; and FIG. 26 is a cross-sectional view taken along the line 26—26 in FIG. 24.

Figure 1:
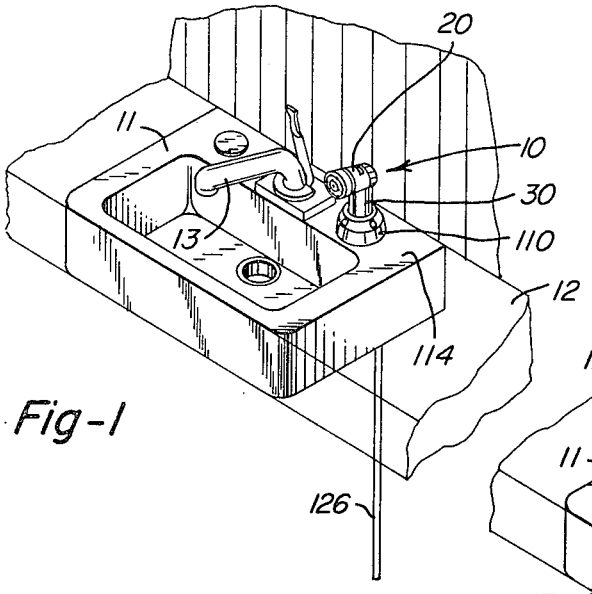
FIG. 1 is a fragmentary perspective view of an examplary installation of one embodiment of a sprayer.
Figure 2:
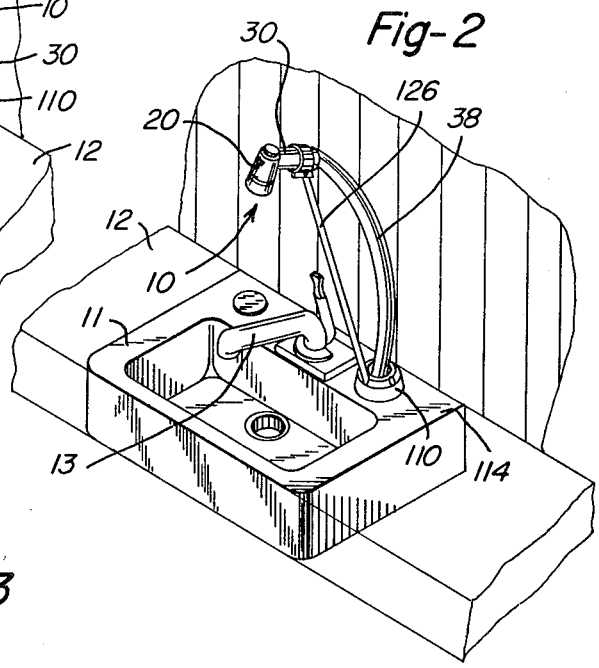
FIG. 2 is a view similar to FIG. 1 but with the sprayer supported in a different position.

A sprayer 10 is illustrated as used in association with a kitchen or bathroom sink or lavatory 11 mounted in a countertop 12. The lavatory includes the usual faucet 13 for delivering hot or cold water as selected by the user. Sprayer 10 may be located in a storage position as shown in FIG. 1 or held in a raised position as shown in FIG. 2. Details of the positioning arrangement will be explained later.

Figure 7:
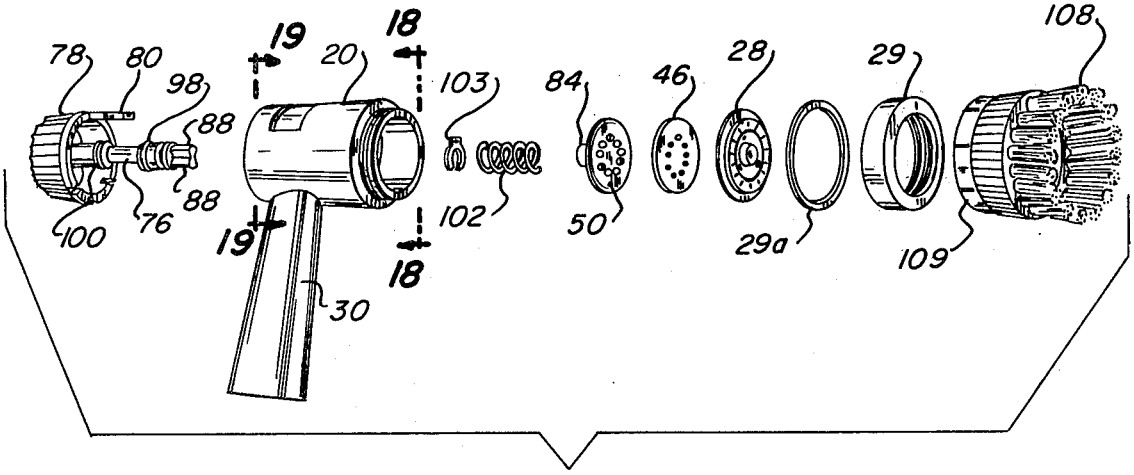
FIG. 7 is an exploded perspective view of the sprayer as shown in the preceding views and with the addition of another component.

In accordance with a presently preferred embodiment, and as best seen in the overall in FIGS. 7 and 8, sprayer 10 includes a hollow housing 20 that has an inlet port 22 and an outlet opening 24. A cap 26 closes opening 24 by being threaded upon that end of housing 20 as indicated at 27. While cap 26 may be formed all in one piece, it preferably is composed of an orifice plate 28 oriented by a lug 28*a* and secured in proper position across opening 24 by a retaining ring 29 threaded onto housing 20 by threads 27. The inner end of ring 29 seats against a trim ring 29*a*. Secured to and downwardly depending from housing 20, like a pistol grip, is barrel 30 the internal bore 32 of which communicates at its upper end with port 22. The lower end of bore 32 is enlarged and internally threaded as at 34 to receive a conventional fitting or coupling 36 which couples a flexible hose 38 to the lower end of bore 32. As at least generally standardized in the plumbing industry, fitting 36 is well known in connection with vegetable sprays installed on kitchen sinks. While forming no part of the present invention, as such, such a fitting is described in detail in co-pending application Ser. No. 784,420, filed Apr. 4, 1977, now U.S. Pat. No. 4,107,046, issued Aug. 15, 1978, and that application is incorporated herein by reference. Hose 38 connects to the conventional diverter valve 39 that cuts off flow to the sink faucet when the usual sprayer is operated.

Figure 5:
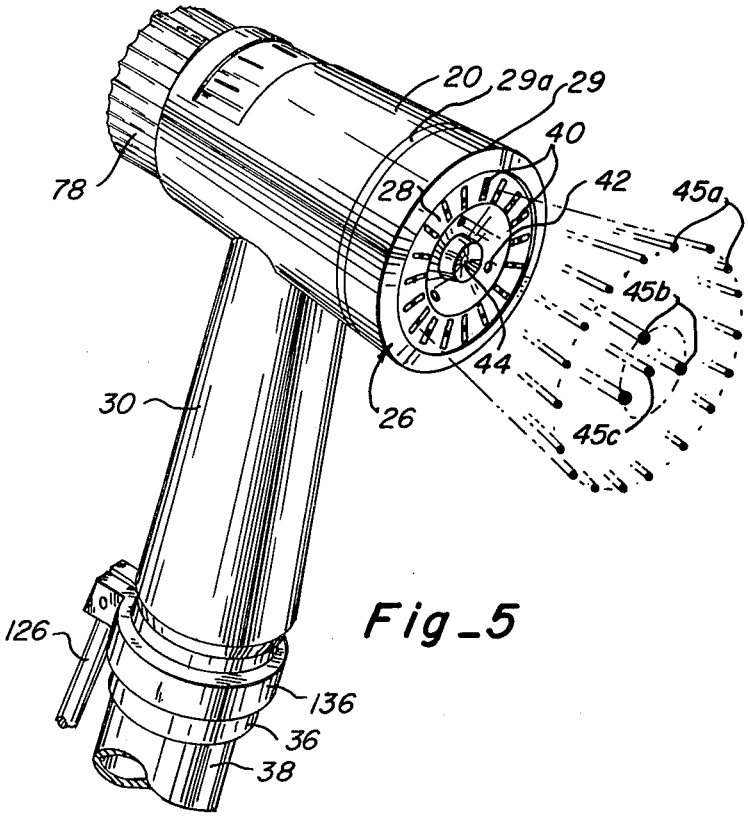
FIG. 5 is an enlarged perspective view of the sprayer itself together with a fragmentary showing of connected elements.
Figure 6:
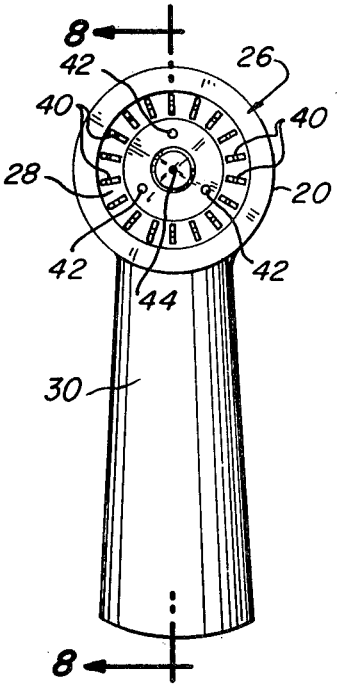
FIG. 6 is a front elevational view of the sprayer as shown in FIG. 5.

Plate 28 includes a plurality of sets of discharge orifices with each set exhibiting an individually different characteristic of orifice flow of fluid from the interior of housing 20. A first set of orifices 40 are circumferentially spaced apart individually and sized and oriented to define an outer fine-spray discharge cone. As illustrated, there are eighteen of orifices 40. A second set of orifices 42 are circumferentially spaced apart individually in a ring which lies concentrically within the ring defined by orifices 40. Orifices 42 are individually each larger in diameter than orifices 40 so as to be sized to define respective jet streams substantially larger than the spray elements discharged from orifices 40. In this case, there are three of orifices 42 spaced apart equally. Yet another orifice 44, which is independent of orifices 40 and 42, is disposed centrally in plate 28 and is of a size smaller than any of orifices 42. With reference to FIG. 5, it will be observed that sprayer 10 thus is capable of emitting a fine-spray cone 45*a* from orifices 40, a pattern of jets 45*b* from orifices 42 or a flow 45*c* from orifice 44 which, as will be discussed further, has a special character.

Disposed within housing 20 are means for selectively opening respective orifice sets to the passage of flow out of the housing and for valving that flow of fluid through the housing. That is, there is selectability as between orifices 40, 42 and 44. In more detail, a porting seal 46 is disposed adjacent to the interior wall of plate 28 and includes a plurality of apertures 48 distributed in an array such that different ones of apertures 48 communicate with respective different ones of orifices 40, 42 and 44. Disposed adjacent to the interior side of seal 46 is a selector plate 50. Plate 50 has to include at least one and in this case includes three holes 52 circumferentially spaced equally in a circle which corresponds in diameter to that of the circle defined by apertures 48. Plate 50 is movable so as to permit selective alignment of holes 52 with different ones of apertures 48 and thereby enables communication between holes 52 and respective different ones of apertures 48.

Porting seal 46 is of a resilient material such as thermoset rubber. Selector plate 50 is of a more rigid material such as a plastic. Moreover, selector plate 50 includes a plurality of nubs 54 which project outwardly toward seal 46 and are so disposed as to be seatable in different ones of apertures 48 upon selective movement of plate 50. A similar nub is formed at the location of each of holes 52, but the latter holes are formed through a central area of those particular nubs so as to leave only an outer perimeter 53 of those nubs remaining, although that perimeter still is seatable in different ones of apertures 48.

It will be observed that individual different ones of each set of orifices 40, 42 and 44 are disposed at respective different distances from the center of plate 28. Apertures 48 are disposed in a circular array which in this case is of a diameter corresponding to that of the circular array defined by orifices 42. Recessed into the interior wall of plate 28 are a first plurality of three channels 56 which serve to communicate between a corresponding three different ones of apertures 48 and orifices 40. Orifices 40 are formed at the bottom of a circular recess 58 so as to permit the distribution of water to all of orifices 40 by way of the three channels 56. Disposed in the middle of each of channels 56, just inside recess 58, is an upright post 60 which serves to maintain planar continuity of the peripheral margin of seal 46 and prevent seal extrusion into channels 56 when under pressure. Another set of channels 62 lead to central orifice 44 from three different respective locations alignable with another corresponding three different ones of apertures 48. At their outer ends, each of channels 62 terminates in a projecting hollow lug 64 of a diameter to seat within the corresponding one of apertures 48, preventing rotation of porting seal 46 as selector plate 50 is rotated.

Plate 28 includes an interior cup 66 that surrounds orifice 44. Each of channels 62 enters the side wall of cup 66 at a tangential angle so as to constitute a nozzle directed into the cup. Thus, fluid flowing through channels 62 effects a swirling of the water which flows outwardly from orifice or opening 44. The size of orifice 44 is sufficiently small that the swirling action creates the discharge of a mist.

Seal 46 includes an outwardly projecting integral lip 70 which circumscribes its outer margin and engages with the inner wall of housing 20 at the front of opening 24. Both the outer margin of lip 70 and that portion of opening 24 are tapered inwardly toward the central axis so as to facilitate assembly and aid in the attainment of a peripheral seal. Seal 46 thereby serves to provide resilient detenting seats for nubs 54 on plate 50, as a barrier between the different fluid passageways formed into plate 28 and to prevent the escape of fluid around the passageways. The entrance of each of apertures 48 is beveled as shown at 72 following which the inner walls of those apertures are tapered slightly inwardly toward the outlet side of the apertures. The bevel facilitates the seating of nubs 54, and the taper enables the achievement of well-defined streams outletting from orifices 42.

It will be seen that the combination of the fluid passageways in plate 28, porting seal 46 and selector plate 50 serves as a composite element by means of which rotatable movement effects a selective determination of the opening of respective sets of orifices. In one possible but not preferred alternative, one or more of apertures 48, alignable with whatever number of openings 52 are provided in plate 50, may be plugged so as to establish one rotative position of plate 50 in which all fluid flow is blocked. Thus, plate 50 may serve both as an on-off valve as well as a selector of discharge characteristics.

Desirably, and as herein specifically embodied, that valving function is separately though relatedly obtained. To that end, a stem 76 is coupled at one end to plate 50 in a manner to permit moving plate 50 in rotation. A knob 78 exposed outside housing 20 and located on the end thereof opposite cap 26 is affixed on the other end of stem 76 for enabling rotation of the stem and corresponding rotation of selector plate 50. A stub 80 outwardly projecting from a portion of knob 78 has a groove 81 which is receivable over any one of a circumferentially-spaced series of ribs 82 on the inner wall of housing 20, so as to detent the rotational position of knob 78 in any one of three different positions corresponding to the selection of the three different sets of orifices 40, 42 and 44. A hollow boss 84 projects integrally inward from plate 50 and includes a pair of space-opposed interior ears 86. The front end of stem 76 is necked down and shaped to define a pair of space-opposing lugs 88 matably received with respect to ears 86 so as to establish a rotational coupling between stem 76 and plate 50. An additional pair of ribs 83, spaced on either side of detent ribs 82, project inwardly from the inner wall of housing 20 and engage stub 80 affixed to know 78 so as to limit the degree of rotation of the knob.

A cylinder 90 integrally formed within housing 20 serves as a valve seat. An intermediate portion 92 of stem 76 is of reduced diameter and terminates at each end with an outward flare followed by respective grooves 94 and 96 in which are seated corresponding resilient O-rings 98 and 100. O-ring 100 serves to prevent the escape of fluid entering through port 22 toward knob 78. On the other hand, O-ring 98 constitutes a valve member engageable with the valve seat 90 upon reciprocation of stem 76 for opening and closing the passage of fluid flow from port 22 toward outlet opening 24. A coil spring 102 encircles boss 84 and is compressed between the interior wall of selector plate 50 and a C-washer 103 seated on stem 76 and normally urged against a transverse wall 104 integrally formed within housing 20. Washer 103 has a slotted lug projecting from one side to facilitate its assembly or disassembly. Spring 102 serves to urge plate 50 tightly against porting seal 46, while at the same time spring 102 urges stem 76 rearwardly so that O-ring or valve member 98 closes the valve assembly and blocks fluid flow. Thus, selector plate 50 and the valve composed of O-ring 98 and valve seat 90 are urged in mutually-opposing directions.

The forward or outlet end portion of cylindrical bore 90 is fluted so as to define a series of lands 105 circumferentially spaced around stem 76. Lands 105 serve to guide the stem and prevent extrusion of O-ring 98 while the water is outletted between the lands upon depression of knob 78.

Slots formed axially into the lower portion of the inner rim of knob 78 form a pair of circumferentially-spaced fingers 106. Those slots are engageable over a hub 107 formed in the facing interior margin of housing 20. The cooperation of fingers 106 and hub 107 prevents rotation of knob 78 when depressed. This avoids excessive wear on seal 46 when under fluid pressure. Also, fingers 106 are so positioned relative to hub 107 as to prevent depression of knob 78 except when it is detented in one of the rotational positions corresponding to a desired flow pattern. Thus, the user cannot actuate flow when knob 78 is rotationally positioned between proper locations.

As shown in FIG. 7, an annular brush 108 has a split-ring collar 109 that is frictionally engaged over ring 29. Of course, brush 108 serves in use to enable scrubbing of an object being sprayed.

Desirably, careful attention is given to the respective flow rates in the different modes or patterns. The fine spray of pattern 45*a* and the jets of pattern 45*b* have orifices sized to deliver a nominal flow rate above one gallon per minute at twenty pounds per square inch water pressure. That is a rate sufficient to cause the conventional flow diverter 39 in a kitchen sink unit to actuate. On the other hand, orifice 44, which delivers a mist spray, is sized to deliver a flow rate below the actuation threshold of the diverter. Typically, that threshold is at about one-half gallon per minute. Moreover, the mist spray flow rate should be sufficiently low as to avoid chattering of the diverter valve. Even with conventional diverter valve 39 operated to a position designed for normal faucet flow, there is sufficient leakage to hose 38 for use of the sprayer in the mist mode of delivery from orifice 44. Thus, the rate of flow from orifice 44 is sufficiently small to avoid excessive humidification of the entire surrounding area of the kitchen or like enclosure.

Figure 3:
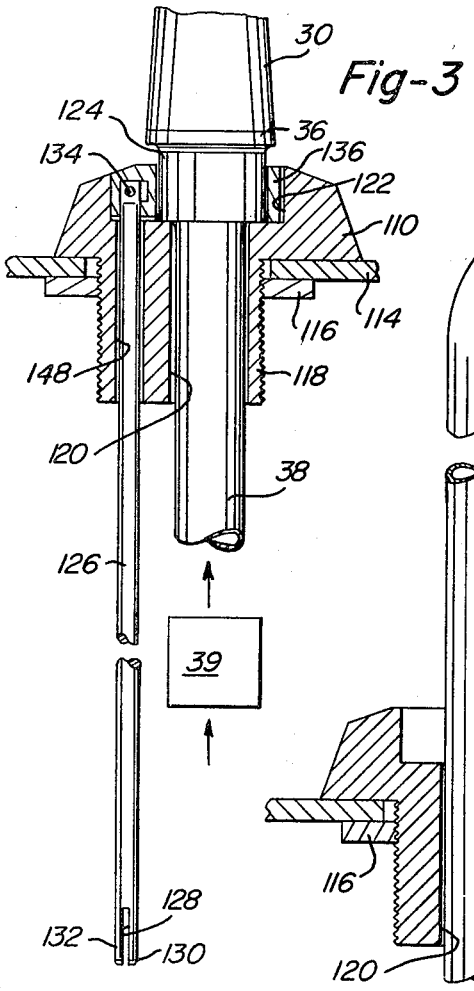
FIG. 3 is an enlarged fragmentary cross-sectional view of the sprayer supported in the position of FIG. 1.
Figure 4:
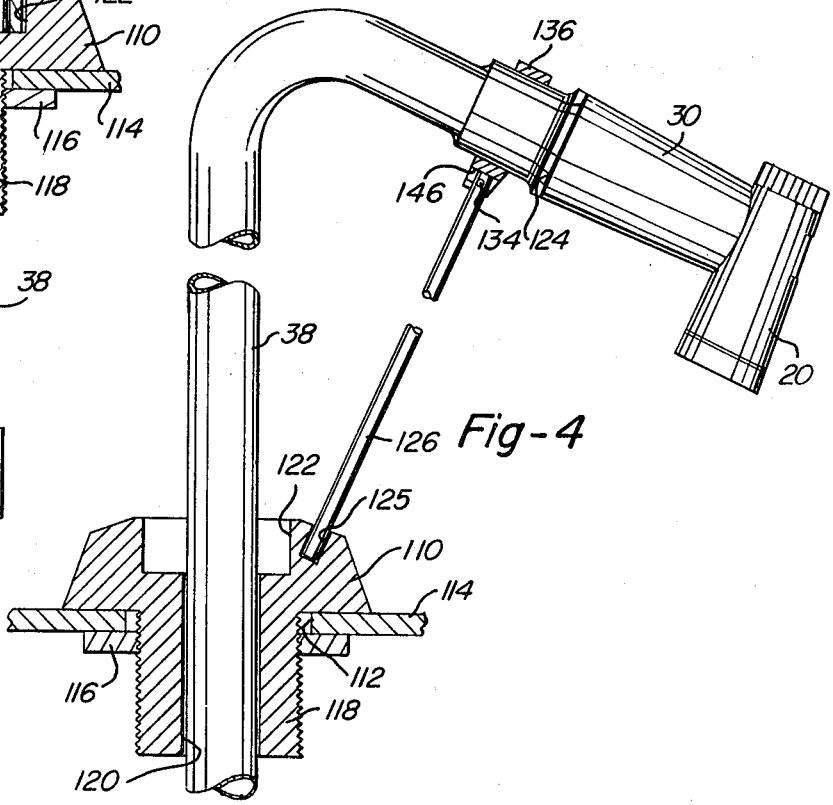
FIG. 4 is an enlarged fragmentary cross-sectional view of the sprayer supported in a position similar to that shown in FIG. 2.

When used with a kitchen sink or the like, a sprayer such as that described often is useful for rinsing dishes or other large objects that are too big to fit under the conventional faucet installation. The separate sprayer can be raised to a higher elevation in that situation. FIGS. 2–4 depict an arrangement for holding sprayer 20 in a raised position. To that end, a special bushing 110 is inserted into the conventional opening 112 formed in the surface flange 114 of the sink and locked into place by a nut 116 threaded onto the lower sleeve 118 of bushing 110. Extending vertically through bushing 110 is a central opening 120 that freely accommodates passage of hose 38 and includes an upwardly-facing hollow boss 122 in which the lower portion 124 of coupling 36 may be seated when the sprayer is in its storage position as shown in FIGS. 1 and 3.

Formed into the upper surface of bushing 110 and slanting slightly in an outward direction is a well 125. Receivable within well 125 is the lower end of an elongated rod 126 that preferably is bifurcated as indicated at 128 so as to provide a pair of tongs 130 and 132 sufficiently spread to insure snug seating. If desired, several of wells 125 may be spaced around bushing 110 so as to permit insertion of rod 126 at any of corresponding different locations.

The upper end of rod 126 is connected by a pin 134 to a clamping ring 136 seatable around portion 124 of coupling 36. Ring 136 is radially split at 138 (FIGS. 23–26) so as to enable its expansion or contraction as either to free or clamp portion 124. Projecting laterally outward from ring 136 on respective opposite sides of radial split 138 are ears 140 and 142 each of which includes mutually transverse interior channels 144 and 146. Channels 144 define a space slightly larger than the diameter of rod 126 so that, when the end of that rod is received within channels 144, ring 136, which is of resilient metal or plastic, is enabled to exert a clamping force upon portion 124. On the other hand, channels 146 define a space slightly narrower than rod 126 so that, when rod 126 is oriented in a position generally parallel to the longitudinal axis of portion 124, ears 140 and 142 are forceably spread apart in a manner to widen the diameter of ring 136 and thereby free portion 124 of the clamping by ring 136.

Also extending downwardly through bushing 110 is a hole 148 in which rod 126 may be received during storage of the sprayer by disposing portion 124 in boss 122. In that storage condition, rod 126 is oriented relative to ring 136 so as to dispose the upper end of rod 126 within channel 146 and thereby free portion 124 to enable withdrawal of the sprayer upwardly and away from ring 136. In the alternative, the sprayer may be elevated and ring 136 together with rod 126 drawn upwardly in which case ring 136 may be placed around portion 124 and be so oriented, as shown in FIG. 4, that the upper end of rod 126 is moved into channel 144 and ring 136 is thereby permitted to clamp upon portion 124 and hold the sprayer in an operative, elevated position.

Of course, the upstandable support assembly just described need not be confined for use with the particular sprayer illustrated and described. The assembly is particularly advantageous in permitting any kind of sprayer to be so mounted as to serve as an auxiliary faucet which may be located at a higher elevation than is conventional.

The sprayer itself which is the subject of this application is decidedly advantageous in permitting the selective determination of several different spray characteristics. Except for the sealing elements, which desirably are of rubber or the equivalent, all parts of the sprayer may readily be molded from plastic material. Requiring no more space than that typically occupied by conventional sprayers which exhibit only a single mode of operation, the newly-disclosed sprayer becomes quite attractive.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

It is claimed:

1. A sprayer stand for use in supporting a fluid spray device supplied by a flexible hose from a source of said fluid, comprising:

a holder receptive of said device for storage;

a releasable clamp securable upon said device;

a support rod of a length to extend between said holder and said clamp for positioning said clamp, with said device therein included, above said holder;

an opening through said holder in which said rod is slidable to accommodate storage of said device;

and an upstanding recess in said holder for seating a lower end of said rod and thereby dispose the upper end of said rod above said holder, said clamp being secured upon said upper end of said rod.

2. A sprayer stand as defined in claim 1 in which said clamp includes means receptive of said upper end of said rod for enabling clamping of said device upon positioning of the lower end of said rod in said recess and unclamping of said device upon storage lowering of said rod through said opening.

* * * * *